US009053597B1

(12) United States Patent
Sackfield

(10) Patent No.: US 9,053,597 B1
(45) Date of Patent: Jun. 9, 2015

(54) BANKNOTE VALIDATOR

(71) Applicant: Innovative Technology Limited, Oldham (GB)

(72) Inventor: Martin Sackfield, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 14/520,489

(22) Filed: Oct. 22, 2014

(30) Foreign Application Priority Data

Dec. 18, 2013 (GB) ..... 1322429.0

(51) Int. Cl.

| | |
|---|---|
| ***G07F 7/04*** | (2006.01) |
| ***G07D 11/00*** | (2006.01) |
| ***B65H 29/60*** | (2006.01) |
| ***B65H 29/58*** | (2006.01) |

(52) U.S. Cl.
CPC ..... *G07D 11/0033* (2013.01); *G07D 11/0018* (2013.01); *B65H 29/60* (2013.01); *B65H 29/58* (2013.01)

(58) Field of Classification Search
CPC ..... B65H 29/58; B65H 29/585; B65H 29/60; B65H 29/62; B65H 29/64; B65H 2404/00; B65H 2404/50; B65H 2404/631; B65H 2404/6321; B65H 2404/693
USPC ..... 194/206, 207; 209/534; 271/225, 264, 271/291, 296–305; 235/379; 382/135
See application file for complete search history.

(56) References Cited

U.S. PATENT DOCUMENTS

| | | | | |
|---|---|---|---|---|
| 5,167,300 | A * | 12/1992 | Yoshida et al. | 186/37 |
| 5,536,002 | A * | 7/1996 | Yoshida et al. | 271/264 |
| 8,764,013 | B2 | 7/2014 | Tomiyoshi et al. | |
| 2004/0060848 | A1 * | 4/2004 | Yurko | 209/657 |
| 2009/0322015 | A1 * | 12/2009 | Mantovan et al. | 271/113 |
| 2010/0194033 | A1 * | 8/2010 | Berendes | 271/239 |
| 2010/0213661 | A1 * | 8/2010 | Fukazawa et al. | 271/3.19 |
| 2013/0181397 | A1 * | 7/2013 | Nunn et al. | 271/303 |
| 2014/0041988 | A1 * | 2/2014 | Yin et al. | 198/364 |

FOREIGN PATENT DOCUMENTS

| | | | |
|---|---|---|---|
| EP | 915436 | B1 | 3/2001 |
| EP | 2189953 | A4 | 1/2012 |
| WO | WO 2004080865 | A1 | 9/2004 |

* cited by examiner

*Primary Examiner* — Jeffrey Shapiro
(74) *Attorney, Agent, or Firm* — Woodard, Emhardt, Moriarty, McNett & Henry LLP

(57) ABSTRACT

A banknote validator (2) comprising: a first banknote input/output aperture (3); a second banknote input/output aperture (4); a banknote transport path (5) interconnecting the first banknote input/output aperture (3) and the second banknote input/output aperture (14); an intermediate validation transport branch (11) disposed between the first and second banknote input/output apertures (3, 4); and a diverter mechanism (12) disposed proximal to an entrance to said intermediate validation transport branch (11); characterized in that the diverter mechanism (12) is moveable between: a first position in which the banknote transport path bypasses the intermediate validation transport branch (11) providing a direct passage between the first and second banknote input/output apertures (3, 4); and a second position in which the banknote transport path is indirect between the first banknote input/output aperture (3) and the second banknote input/output aperture (4) and is via the intermediate validation transport branch (11).

19 Claims, 7 Drawing Sheets

BANKNOTE VALIDATOR

The present invention generally relates to apparatus for receiving, storing and/or dispensing of banknotes, vouchers, coupons and the like. Specifically, the present invention relates to a banknote validator. It should be noted that the term 'banknote' is non-limiting and used here to mean any item of paper currency, bill voucher, ticket, card or sheet that may have a value, monetary or otherwise, or may be used to convey information.

There are many forms of banknote validation known in the art and there are numerous variants of conventional banknote validators.

One such prior art banknote validator is shown in FIG. 1. Here, a banknote validator 100 comprises a banknote storage container 101 and a banknote validation unit 102. The banknote validator 100 includes a generally T-shaped banknote transport path 105 that extends between a first input/output aperture 103 and a second input/output aperture 104. The banknote transport path also extends into the banknote storage container 101 via an intermediate validation transport branch 111.

A banknote inserted into the banknote validator 100 through the input/output aperture 103 is conveyed by a transport mechanism to the intermediate validation transport branch 111 where a sensor device interrogates the banknote for authenticity. If the banknote is determined to be authentic it is stored in the storage container 101 or it is transported back along the intermediate transport branch 111 and routed to the second input/output aperture 104 from where it passes to an ancillary device [not shown] for further processing and/or storage. Typically, the ancillary device will be a banknote drum storage device attachable to the rear of the banknote validator 100.

As shown in FIGS. 2 and 3, the validator unit 102 of a conventional banknote validator 100 includes a diverter mechanism 112 positioned at, and extending into, the mouth of the intermediate transport branch 111. The diverter mechanism 112 is operated via an actuator 110 which is controlled by the ancillary device [not shown]. The validator unit 102 also includes drive wheels 106 to 109 for conveying banknotes along the banknote transport path. Here, drive wheel 106 is motor-driven, whilst drive wheels 107, 108 and 109 are passive and move in response to rotation of drive wheel 106.

As illustrated in the Figures, the diverter mechanism 112 can pivot between two distinct positions: one in which the path to the second input/output aperture 104 from the intermediate branch 111 is closed [FIG. 2], and one in which the path from the intermediate branch 111 to the first input/output aperture 103 [not shown] is closed. In this way an incoming banknote can be routed to the intermediate branch 111 [FIG. 2] for authentication and then, if required, be routed to the second input/output aperture 104 [FIG. 3].

A problem exists with the above described validator unit 102 in that banknotes, or other sheet media such as coupons or vouchers, contained within the ancillary device cannot be input into the validator unit 102 via the second input/output aperture 104 to be dispensed from the first input/output aperture 103 without being routed into the intermediate branch 111 because a direct path between the two input/output apertures is blocked by the diverter mechanism 112. Furthermore, this problem is exacerbated by the fact that drive wheel 108 always rotates in the opposite sense to that of the motor-driven wheel 106 and, as a result of this, when drive wheel 108 is rotating in the correct manner to convey a banknote input from the second input/aperture 104, it would inevitably encounter drive wheel 106 rotating in the wrong direction, even if the problem of the intervening diverter mechanism had been overcome.

According to an aspect of the present invention there is provided a banknote validator as defined in claim 1.

Preferably, the diverter mechanism includes a pivotal gate member which, when the diverter mechanism is in the second position, is moveable between a position where passage between the intermediate validation transport branch and the first banknote input/output aperture is open, and a position in which passage between the intermediate validation transport branch and the first banknote input/output aperture is closed.

Advantageously, when passage between the intermediate validation transport branch and the first banknote input/output aperture is closed, passage between the intermediate validation transport branch and the second banknote input/output aperture is open.

Preferably, the diverter mechanism includes a plurality of spaced-apart articulated winged members forming a substantially V-shaped spine structure, each winged member including a central slotted portion configured to receive the pivotal gate member, and the pivotal gate member comprises a plurality of tine portions interconnected by a common axle, each tine portion alternately projecting between adjacent winged members, and wherein the common axle extends lengthwise through each central slotted portion. The common axle is arranged to reciprocate within each slotted portion in a direction perpendicular to an axial direction of the common axle.

Each winged member preferably comprises a pair of opposed arm portions extending laterally from the central slotted portion to form an articulated banknote support surface and, advantageously, underside sections of the arm portions opposite to the banknote support surface are curved to form banknote diversion guide means.

Preferably, the intermediate validation transport branch extends in a plane that is substantially orthogonal to a plane in which the banknote transport path lies.

Preferably, the diverter mechanism is linked to a follower arm moveable between a position in which the diverter mechanism is in the first position and a position in which the diverter mechanism is in the second position, and the follower arm is moveable via operation of a motor-driven cam device.

In a preferred embodiment the motor-driven cam device is coaxial with a central motorised gear of a validator gear train, and wherein the motor-driven cam device includes a minor gear engaged with the central motorised gear, the minor gear being moveable between engagement with a first gear and engagement with a second gear.

Advantageously, the first gear is meshed with a drive wheel proximal to the second banknote input/output aperture, the second gear is an idler gear meshed with the first gear, and the central motorised gear drives a main drive wheel which is common to both the banknote transport path and the intermediate validation transport branch.

In the first position the minor gear is meshed with the idler gear and the drive wheel proximal to the second banknote input/output aperture rotates in the same sense as the main drive wheel. In contrast, in the second position the minor gear is meshed with the first gear and the drive wheel proximal to the second banknote input/output aperture rotates in the opposite sense to the main drive wheel.

An embodiment of the present invention will now be described, by way of example only, with reference to the accompanying drawings, in which.

Figure 1:
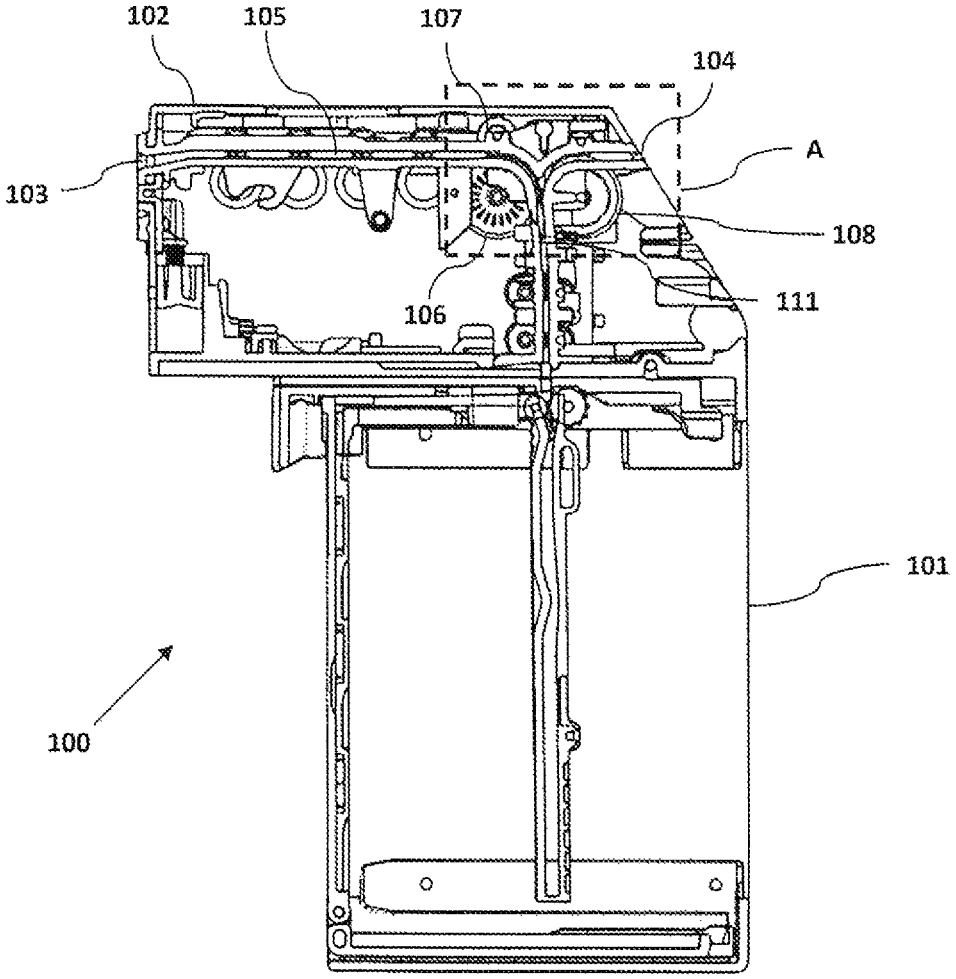
Fig. 1. PRIOR ART
FIG. 1 shows a sectional side elevation view of a prior art banknote validator.
Figure 2:
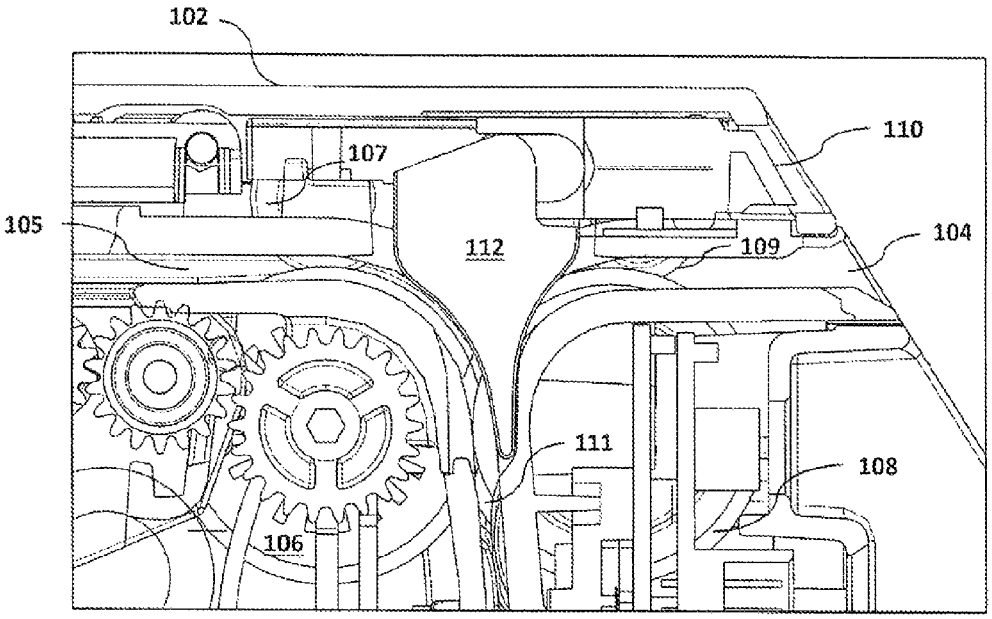
PRIOR ART Fig. 2.
FIG. 2 shows a magnified view of the area labelled 'A' in FIG. 1.
Figure 3:
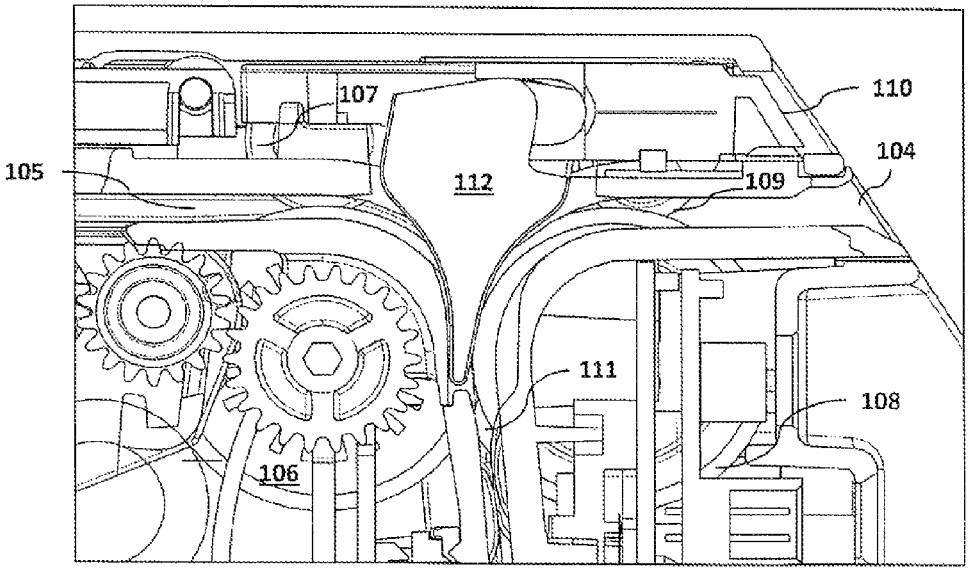
PRIOR ART Fig. 3.
FIG. 3 shows another view of the area labelled 'A' in FIG. 1.
Figure 4:
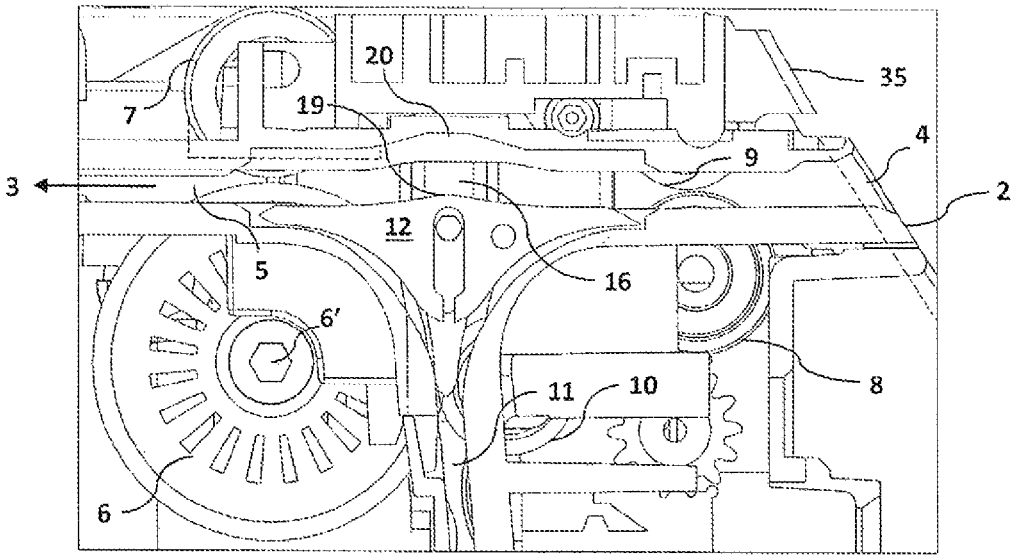
FIG. 4 is a partial sectional view of the validator unit of the present invention showing a diverter mechanism.

As shown in FIG. 4, a banknote validator 2 of the present invention includes a banknote transport path 5 extending between a first input/output aperture 3 and a second input/output aperture 4, the second input/output aperture 4 being located at the rear of the banknote validator 2 and communicable with an ancillary device [not shown] that is configured to receive and process banknotes output via the second input/output aperture 4. The location of the first input/output aperture 3 is indicated by the arrow and it coincides with the location of the first input/output aperture 103 shown in FIG. 1.

The banknote transport path 5 includes an intermediate validation transport branch 11 positioned between the first and second input/output apertures and extending in a substantially orthogonal direction to the main transport path between the apertures. Although not shown, the intermediate validation transport branch 11 traverses a validation sensor unit which is employed to optically interrogate and determine the authenticity of banknotes that are routed to this section of the banknote transport path. It should be noted that any conventional validation process can be employed to determine the authenticity of banknotes, and the present invention is not dependent upon the particular validation means chosen.

Figure 8:
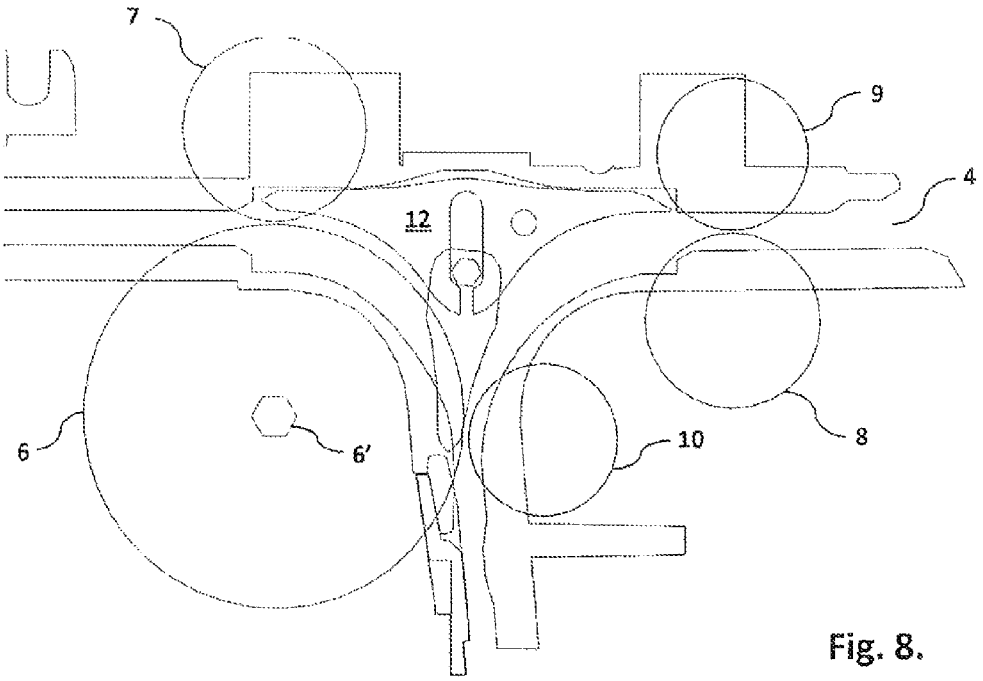
FIG. 8 is a reduced schematic including the relative positions of drive wheels of the validator unit of the present invention.

The banknote validator 2 includes a banknote drive mechanism comprising a plurality of banknote drive wheels. The plurality of banknote drive wheels includes a motorised main drive wheel 6 connected, via axle 6', to a drive mechanism gear train [see FIGS. 12 and 13]. The main drive wheel 6 interacts through friction with a pair of neighbouring pinch wheels 7, 10 [see also FIGS. 4 and 8].

In operation, drive wheel 6 and drive wheel 7 rotate in unison to transport a banknote [not shown] to or from the first input/output aperture 3, and in turn drive wheel 6 and drive wheel 10 combine to transport a banknote to or from the intermediate validation transport branch 11.

In a similar manner, drive wheel 8 operates together with drive wheel 9 to transport a banknote to and from the second input/output aperture.

Figure 9:
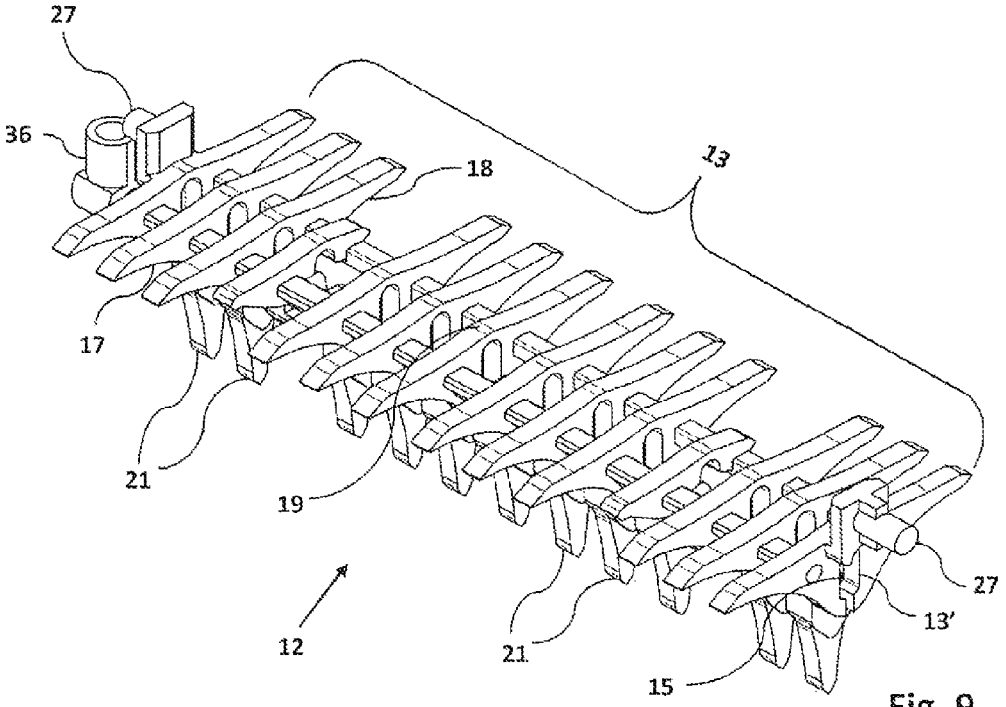
FIG. 9 shows a perspective plan view of a diverter mechanism of the present invention.

The banknote validator 2 includes a diverter mechanism 12 and, as shown in FIG. 9, this comprises a plurality of articulated winged members 13 each having a centrally positioned slot 13'. The diverter mechanism 12 further comprises a pivotal gate member 14 formed from a plurality of spaced-apart tine portions 21. The tine portions 21 are linked by a common axle 15 that extends lengthwise through each slot 13' to form, in combination with the winged members 13, a generally V-shaped spine structure. Each of the series of tine portions 21 extend between adjacent wing members to form a comb-like structure that is pivotal about the common axle 15.

Each winged member 13 and tine portion 21 is preferably fabricated from a plastics material, and the common axle is preferably constructed from a polished metal.

A winged member 13 includes a pair of opposed arm portions 22, 23 that extend outward in a lateral direction from the axial lengthwise direction of the diverter mechanism 12. The underside of each arm portion 22 has a curved profile and the plurality of which form, in combination, a first diversion guide means 17, and the underside of each arm portion 23 forms an opposing second diversion guide means 18 which is substantially a mirror of the first [see FIG. 9].

The diverter mechanism 12 is configured to operate in two distinct positions selectable through operation of the actuator 35 shown in FIG. 4. As with the prior art banknote validator discussed above, this actuator is controlled by a piggyback ancillary device. The operation of the diverter mechanism 12 will now be described with reference to FIGS. 5 to 7.

Diverter Mechanism: Position One

Figure 5:
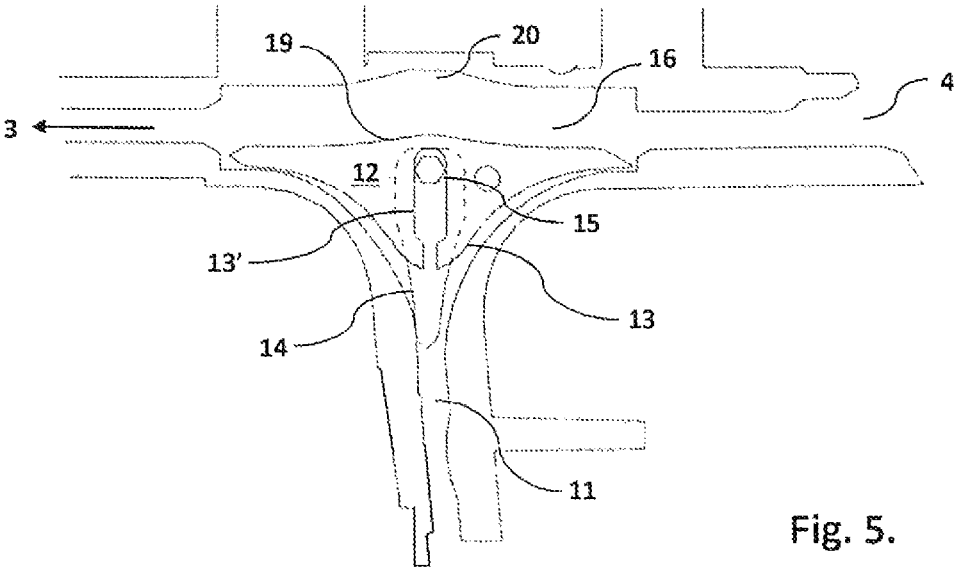
FIG. 5 is a reduced schematic of the partial sectional view shown in FIG. 4.
Figure 10:
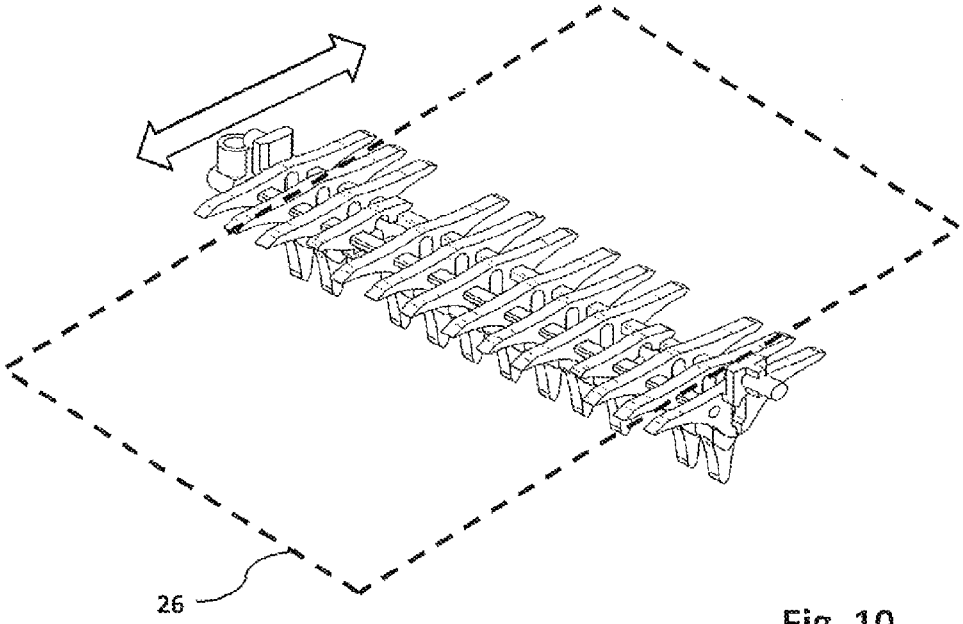
FIG. 10 shows a banknote traversing an upper surface of the diverter mechanism of the present invention.

In the first position, as shown in FIG. 5, the diverter mechanism 12 bridges a throat section of the intermediate transport branch 11 such that entrance to this branch is closed and an open unobstructed passageway 16 is provided between the first input/output 3 aperture and the second input/output aperture 4. Advantageously, an upper surface of the diverter mechanism 12 functions as a banknote guide and support surface 19 to facilitate the passage of a banknote 26 either to or from the first and second input/output apertures 3, 4 [see also FIG. 10]. The banknote guide and support surface 19 is comprised of the combination of each upper surface of the plurality of winged members 13 to form an articulated spaced-apart support structure [see FIG. 9].

Diverter Mechanism: Position Two

Figure 6:
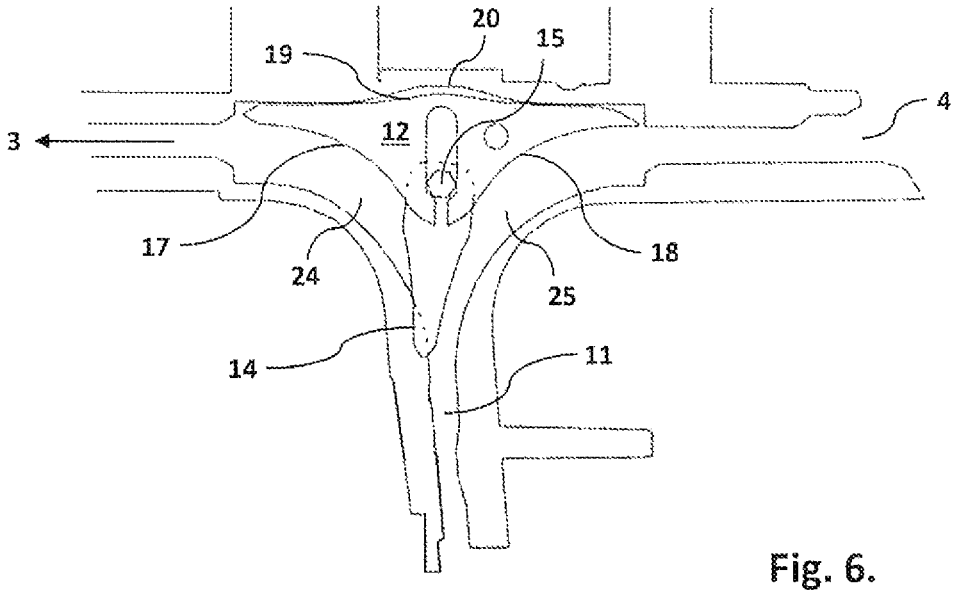
FIG. 6 is another reduced schematic of the partial sectional view shown in FIG. 4.
Figure 7:
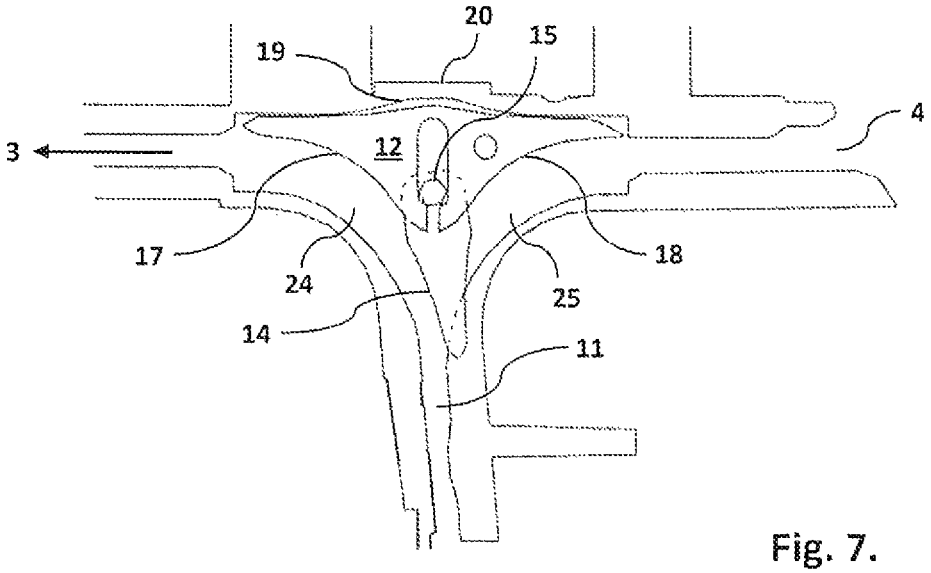
FIG. 7 is a further reduced schematic of the partial sectional view shown in FIG. 4.

In the second position, as illustrated by FIGS. 6 and 7, the diverter mechanism 12 is disposed such that the banknote guide and support surface 19 of the diverter mechanism is accommodated within a passageway recess 20, and a direct path between the first input/output aperture 3 and the second input/output aperture 4 is closed.

When the diverter mechanism 12 is in the second position, the first and second diversion guide means 17, 18 respectively form first and second arcuate passageways 24, 25 separated by the pivotal gate member 14.

The pivotal gate member 14 is moveable between a position in which the intermediate validation transport branch 11 is closed to the first arcuate passageway 24 [FIG. 6], and a position in which the intermediate validation transport branch 11 is closed to the second arcuate passageway 25 [FIG. 7]. As noted above, operation of the pivotal gate member 14 is controlled by an ancillary device [not shown] through operation of the actuator 35. The actuator 35 is positioned proximal to the second input/output aperture and it is mechanically linked to the pivotal gate member 14 via a coupling socket 36 attached to a distal end of the common axle 15 [see FIG. 9].

Figure 11:
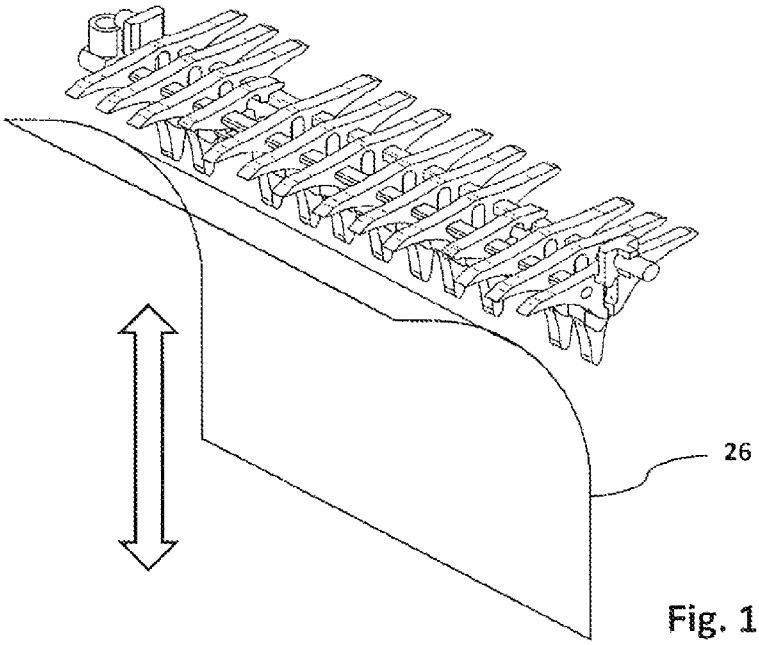
FIG. 11 shows a banknote traversing an underside surface of the diverter mechanism of the present invention.

FIG. 11 depicts the movement of a banknote 26 when the diverter mechanism 12 is in the second position and the intermediate validation transport branch 11 is closed to the second arcuate passageway 25 and, consequently, open to the first arcuate passageway 24. In this way the banknote 26 is free to be transported between the intermediate validation branch 11 and the first input/output aperture 3, and vice versa. Although not shown, it should be recognised that a corresponding arrangement exists where a banknote is transportable between the intermediate validation branch 11 and the second input/output aperture 4 when the pivotal gate member 14 is in the position shown in FIG. 6.

The operation of the banknote validator drive mechanism and gear train will now be described with reference to FIGS. 12 and 13. It should be noted that the views shown in these figures are from the opposite side of the banknote validator 2 to the view shown in FIG. 4. As a result, corresponding elements will appear transposed.

Figure 12:
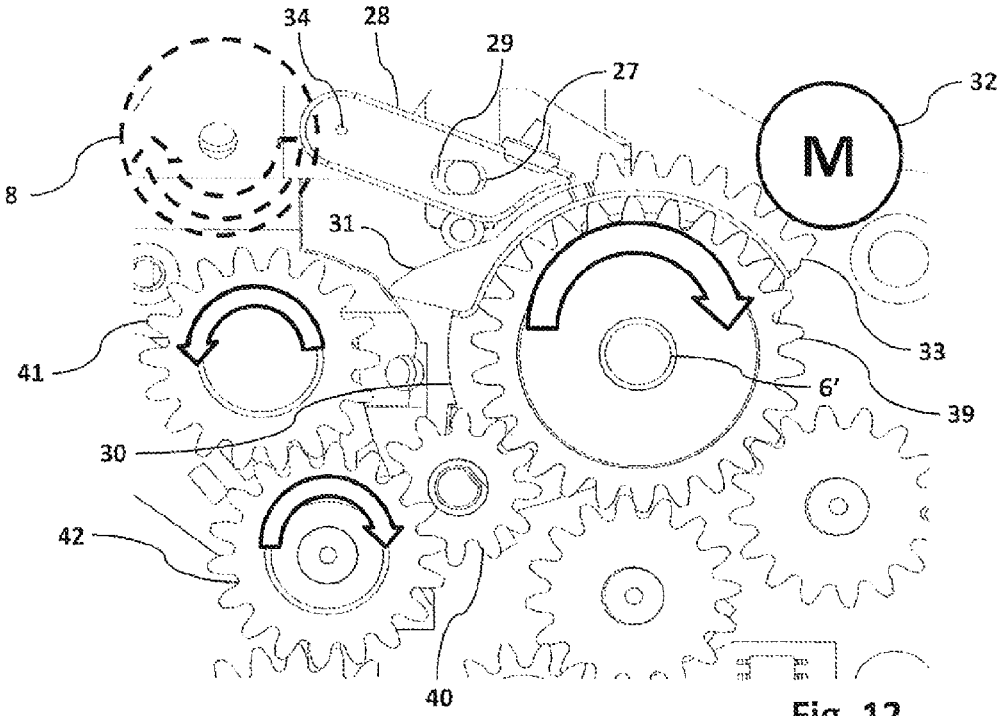
FIG. 12 shows a partial side elevation sectional view of a gear train of the present invention.

FIG. 12 shows the arrangement of the gear train when the diverter mechanism 12 is in the first position as described above.

A main gear 39 of the gear train is connected to, and coaxial with, the main drive wheel 6 [not shown]. The main gear 39, and consequently the main drive wheel 6, is driven directly through axle 6' by a drive mechanism motor [not shown].

A cam carriage 30 is provided that is coaxial with the main gear 39 but is independently rotatable about the axle 6'. The cam carriage 30 comprises a cam profile 31 and a cogged cam element 33 drivable by a cam motor 32. The cam carriage 30 includes a minor gear 40 which is meshed to the main gear 39, but which rotates around the main gear 39 in unison with the movement of the cam carriage 30 to which the minor gear 40 is rotatably connected.

In the arrangement shown in FIG. 12 the cam profile 31 is disengaged from a follower arm 28. The follower arm 28 includes a slot 29 configured to receive a diverter actuation lug 27. A corresponding actuation lug 27 is positioned on the opposite side of the diverter mechanism 12 [see FIGS. 9 to 11], and each of the pair of actuation lugs 27 extend outwardly in an axial direction from the diverter mechanism 12 and engage with a corresponding follower arm 28. It should be noted that only the follower arm 28 proximal to the gear train engages with the cam profile 31, and that the opposing distal follower arm is linked to, and operates in unison with this follower arm 28 via an interconnecting shaft 34.

In the first position, the minor gear 40 is in meshed engagement with an idler gear 42 which in turn is meshed with a first gear 41. The first gear 41 is meshed with and drives the drive wheel 8 [shown in broken line].

The rotation arrows depicted in FIG. 12 indicate an example movement of the gear train when the main gear 39 is driven to rotate in a clockwise manner. Here, the idler gear 42 rotates in the same sense as the main gear 39 by virtue of the interconnecting minor gear 40. The idler gear 42 in turn causes the drive wheel 8 to rotate in the same sense as the main gear 39 as a consequence of the intervening first gear 41.

It should be evident that reversing the direction of the main gear 39 when the diverter mechanism 12 is in the first position will result in the drive wheel 8 reversing its direction to rotate in the same sense.

During first position operation the main drive wheel 6 and the drive wheel 8 rotate in unison in the same direction. Thus, a banknote is conveyed from the first input/output aperture 3 to the second input/output aperture 4, or vice versa, without encountering any drive wheels rotating in an incorrect sense that might lead to an obstruction or banknote jam.

Figure 13:
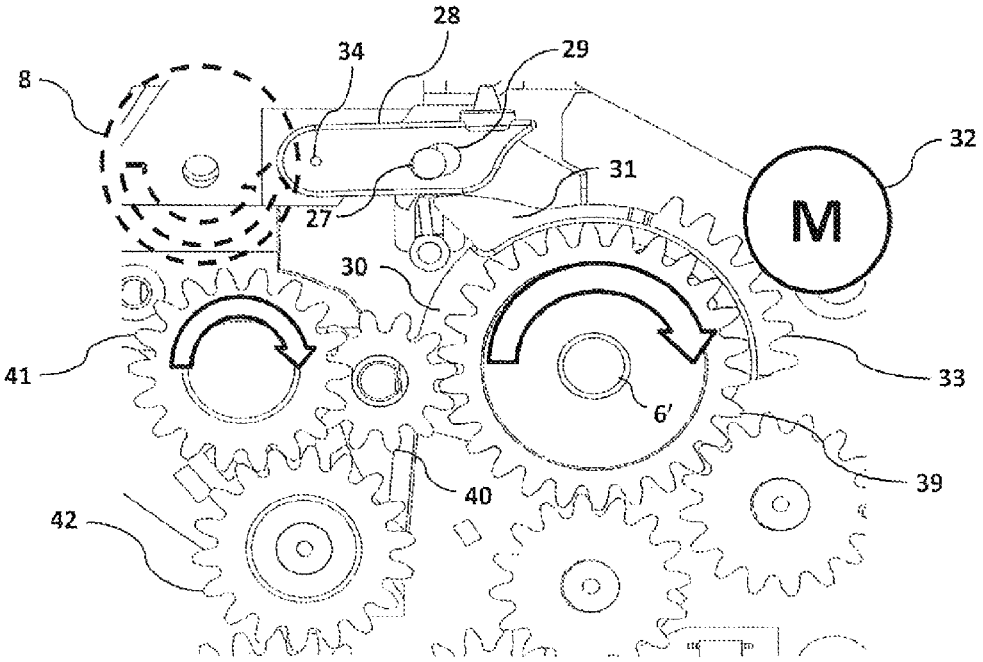
FIG. 13 shows another partial side elevation view of a gear train of the present invention.

In contrast, and as shown in FIG. 13, the situation is reversed when the diverter mechanism 12 is in the second position. Here, the cam motor 32, through operation on the cogged cam element 33, has driven the cam carriage 30 in a clockwise direction from the position shown in FIG. 12, such that the cam profile 31 has engaged with the follower arm 28. As the cam carriage 30 rotates in a clockwise manner, minor gear 40 disengages with the idler gear 42 and directly meshes with the first gear 41.

Engagement of the cam profile 31 with the follower arm 28 causes the diverter mechanism 12 to move into the second position as described above.

FIG. 13 includes rotation arrows that indicate an example movement of the gear train when the main gear 39 is driven to rotate in a clockwise manner. Here, the first gear 41 rotates in the same sense as the main gear 39 as a result of the interconnecting minor gear 40, and the first gear 41 in turn causes the drive wheel 8 to rotate in the opposite sense to the main gear 39.

During second position operation the main drive wheel 6 and drive wheel 8 rotate together in opposite directions.

Thus, when a banknote is conveyed from the intermediate validation transport branch 11 to the second input/output aperture 4, or vice versa, the main drive wheel 6 and the drive wheel 8 are correctly rotating in opposite senses to facilitate unhindered passage of a banknote. Likewise, when a banknote is conveyed from the intermediate validation transport branch 11 to the first input/output aperture 4, or vice versa, the drive wheels are again correctly rotating in opposite directions.

Advantageously, the banknote validator described above provides an apparatus in which a banknote, or similar such sheet item, can be conveyed from and to opposing apertures, either directly or via an intermediate holding position, without the need for a complex diverting mechanism or separate drive mechanisms.

The invention claimed is:

1. A banknote validator (2) comprising:

a first banknote input/output aperture (3);

a second banknote input/output aperture (4);

a banknote transport path (5) interconnecting the first banknote input/output aperture and the second banknote input/output aperture;

an intermediate validation transport branch (11) disposed between the first and second banknote input/output apertures; and a diverter mechanism (12) disposed proximal to an entrance to said intermediate validation transport branch;

a lengthwise extending axle;

wherein the diverter mechanism is slidably movable on said axle in a direction perpendicular to said axle between:

a first position in which the banknote transport path (5) bypasses the intermediate validation transport branch (11) providing a direct passage between the first and second banknote input/output apertures (3,4); and a second position in which the banknote transport path (5) is indirect between the first banknote input/output aperture (3) and the second banknote input/output aperture (4) and is via the intermediate validation transport branch (11);

and wherein the diverter mechanism (12) includes a pivotal gate member (14) which, when the diverter mechanism is in the second position, is pivotable on said axle between a position where passage between the intermediate validation transport branch and the first banknote input/output aperture is open, and a position in which passage between the intermediate validation transport branch and the first banknote input/output aperture is closed.

2. A banknote validator as claimed in claim 1, wherein when passage between the intermediate validation transport branch (11) and the first banknote input/output aperture (3) is closed, passage between the intermediate validation transport branch (11) and the second banknote input/output aperture (4) is open.

3. A banknote validator as claimed in claim 1, wherein the diverter mechanism (12) includes a plurality of spaced-apart articulated winged members (13) forming a substantially V-shaped spine structure, each winged member including a central slotted portion (13') configured to receive the pivotal gate member (14).

4. A banknote validator as claimed in claim 3, wherein the pivotal gate member (14) comprises a plurality of tine portions (21) interconnected by said axle (15), each tine portion (21) alternatively projecting between adjacent winged members (13), and wherein said axle (15) extends lengthwise through each central slotted portion (13').

5. A banknote validator as claimed in claim 4, wherein each winged member (13) comprises a pair of opposed arm portions extending laterally from the central slotted portion (13') to from an articulated banknote support surface (19).

6. A banknote validator as claimed in claim 5, wherein underside section of the arm portions opposite to the banknote support surface are curved to form banknote diversion guide means (17, 18).

7. A banknote validator as claimed in claim 6, wherein said axle (15) is arranged to reciprocate within each slotted portion in a direction perpendicular to an axial direction of said axle.

8. A banknote validator as claimed in claim 1, wherein the intermediate validation transport branch (11) extends in a plane that is substantially orthogonal to a plane in which the banknote transport path (5) lies.

9. A banknote validator as claimed in claim 1, wherein the diverter mechanism (12) is moveably linked to a follower arm (28), wherein said follower arm is reciprocally movable between a position in which the diverter mechanism is in the first position and a position in which the diverter mechanism is in the second position.

10. A banknote validator as claimed in claim 9, wherein the follower arm (28) is moveable via operation of a motor-driven cam device (30, 31, 33).

11. A banknote validator comprising:

a first banknote input/output aperture (3);

a second banknote input/output aperture (4);

a banknote transport path (5) interconnecting the first banknote input/output aperture and the second banknote input/output aperture;

an intermediate validation transport branch (11) disposed between the first and second banknote input/output apertures; and a diverter mechanism (12) disposed proximal to an entrance to said intermediate validation transport branch;

a lengthwise extending axle;

wherein the diverter mechanism is slidably movable on said axle in a direction perpendicular to said axle between:

a first position in which the banknote transport path (5) bypasses the intermediate validation transport branch (11) providing a direct passage between the first and second banknote input/output apertures (3,4); and a second position in which the banknote transport path (5) is indirect between the first banknote input/output aperture (3) and the second banknote input/output aperture (4) and is via the intermediate validation transport branch (11);

and wherein the diverter mechanism (12) includes a pivotal gate member (14) which, when the diverter mechanism is in the second position, is pivotable on said axle between a position where passage between the intermediate validation transport branch and the first banknote input/output aperture is open, and a position in which passage between the intermediate validation transport branch and the first banknote input/output aperture is closed;

the diverter mechanism (12) is movably linked to a follower arm (28), wherein said follower arm is reciprocally movable between a position in which the diverter mechanism is in the first position and a position in which the diverter mechanism is in the second position, the follower arm (28) is moveable via operation of a motor-driven cam device (30, 31, 33) wherein the motor-driven cam device (30, 31, 33) is coaxial with a central motorised gear (39) of a validator gear train, and wherein the motor-driven cam device includes a minor gear (40) engaged with the central motorised gear (39) and moveable between engagement with a first gear (41) and engagement with a second gear (42).

12. A banknote validator as claimed in claim 11, wherein the first gear (41) is meshed with a drive wheel (8) proximal to the second banknote input/output aperture, and wherein the second gear (42) is an idler gear meshed with the first gear (41).

13. A banknote validator as claimed in claim 12, wherein the central motorised gear (39) drives a main drive wheel (6), said main drive wheel (6) common to both the banknote transport path (5) and the intermediate validation transport branch (11).

14. A banknote validator as claimed in claim 13, wherein in the first position the minor gear (40) is meshed with the idler gear (42) and the drive wheel proximal to the second banknote input/output aperture (4) rotates in the same sense as the main drive wheel (6).

15. A banknote validator as claimed in claim 13, wherein in the second position the minor gear (40) is meshed with the first gear (41) and the drive wheel (8) proximal to the second banknote input/output aperture (4) rotates in the opposite sense to the main drive wheel (6).

16. A banknote validator comprising:

a first banknote input/output aperture;

a second banknote input/output aperture;

a banknote transport path interconnecting the first banknote input/output aperture and the second banknote input/output aperture;

an intermediate validation transport branch disposed between the first and second banknote input/output apertures; and a diverter mechanism disposed proximal to an entrance to said intermediate validation transport branch;

a lengthwise extending axle;

wherein the diverter mechanism is slidably movable on said axle in a direction perpendicular to said axle between:

a first position in which the banknote transport path bypasses the intermediate validation transport branch providing a direct passage between the first and second banknote input/output apertures; and a second position in which the banknote transport path is indirect between the first banknote input/output aperture and the second banknote input/output aperture and is via the intermediate validation transport branch;

and wherein the diverter mechanism includes a pivotal gate member which, when the diverter mechanism is in the second position, is pivotable on said axle between a position where passage between the intermediate validation transport branch and the first banknote input/output aperture is open, and a position in which passage between the intermediate validation transport branch and the first banknote input/output aperture is closed;

the diverter mechanism is movably linked to an arm, wherein the arm is movable between a position in which the diverter mechanism is in the first position and a position in which the diverter mechanism is in the second position, said arm is movable by a driver with a gear mechanism for controlling movement.

17. A banknote validator comprising:

a first banknote input/output aperture;

a second banknote input/output aperture;

a banknote transport path interconnecting the first banknote input/output aperture and the second banknote input/output aperture;

an intermediate validation transport branch disposed between the first and second banknote input/output apertures; and a diverter mechanism disposed proximal to an entrance to said intermediate validation transport branch;

a lengthwise extending axle;

wherein the diverter mechanism is slidably movable on said axle in a direction perpendicular to said axle between:

a first position in which the banknote transport path bypasses the intermediate validation transport branch providing a direct passage between the first and second banknote input/output apertures; and a second position in which the banknote transport path is indirect between the first banknote input/output aperture and the second banknote input/output aperture and is via the intermediate validation transport branch;

and wherein the diverter mechanism includes a pivotal gate member which, when the diverter mechanism is in the second position, is pivotable on said axle between a position where passage between the intermediate validation transport branch and the first banknote input/output aperture is open, and a position in which passage between the intermediate validation transport branch and the first banknote input/output aperture is closed, and wherein the diverter mechanism includes a plurality of spaced-apart articulated winged members forming a substantially V-shaped spine structure, each winged member including a central slotted portion configured to receive the pivotal gate member, the pivotal gate member comprises a plurality of tine portions interconnected by said axle, each tine portion alternatively projecting between adjacent winged members, and wherein said axle extends lengthwise through each central slotted portion, said central slotted portion includes a slot with a first end and a second end allowing said pivotal gate member to slide to a position on said axle positioning said axle at said first end in which the banknote transport path bypasses the intermediate validation transport branch providing a direct passage between the first and second banknote input/output apertures and to a position on said common axle positioning said axle at said second end in which said direct passage is blocked between said first and second banknote input/output apertures.

18. A banknote validator as claimed in claim 17, wherein each winged member comprises a pair of opposed arm portions extending laterally from the central slotted portion to form an articulated banknote support surface.

19. A banknote validator as claimed in claim 18, wherein underside sections of the arm portions opposite to the banknote support surface are curved to form banknote diversion guide means.

* * * * *